US005572914A

United States Patent [19]

Coleman

[11] Patent Number: 5,572,914

[45] Date of Patent: Nov. 12, 1996

[54] TWEEZER-PLIERS HAVING MULTIPLE GRIPPING MEANS

[76] Inventor: Kenneth J. Coleman, P.O. Box 71, Crystal Lake, Ill. 60039-0071

[21] Appl. No.: 417,300

[22] Filed: Apr. 5, 1995

[51] Int. Cl.[6] ..... B25B 7/02

[52] U.S. Cl. ..... 81/424.5; 81/418; 30/134

[58] Field of Search ..... 81/418, 424.5, 81/419, 417, 415, 300; 30/134, 135

[56] References Cited

U.S. PATENT DOCUMENTS

| | | | |
|---|---|---|---|
| 97,399 | 11/1869 | Holmes | 81/418 |
| 2,477,335 | 7/1949 | Isele | 81/426 |
| 2,885,781 | 5/1959 | Bauer | 81/417 |

FOREIGN PATENT DOCUMENTS

| | | | |
|---|---|---|---|
| 2360336 | 7/1974 | Germany | 81/415 |

*Primary Examiner*—Bruce M. Kisliuk
*Assistant Examiner*—Joni B. Danganan
*Attorney, Agent, or Firm*—Baker & McKenzie

[57] ABSTRACT

A pliers having increased gripping capacity due to a pincer point at its tip and a center groove located inwardly from the tip into which a workpiece can be deformed so as to implicate possible shearing resistance to separation of the workpiece from the tool, yet possessing greater control sensitivity for grasping very small objects, including flat sheet material, due to the pincer point on the tip thereof.

9 Claims, 2 Drawing Sheets

Fig.1.
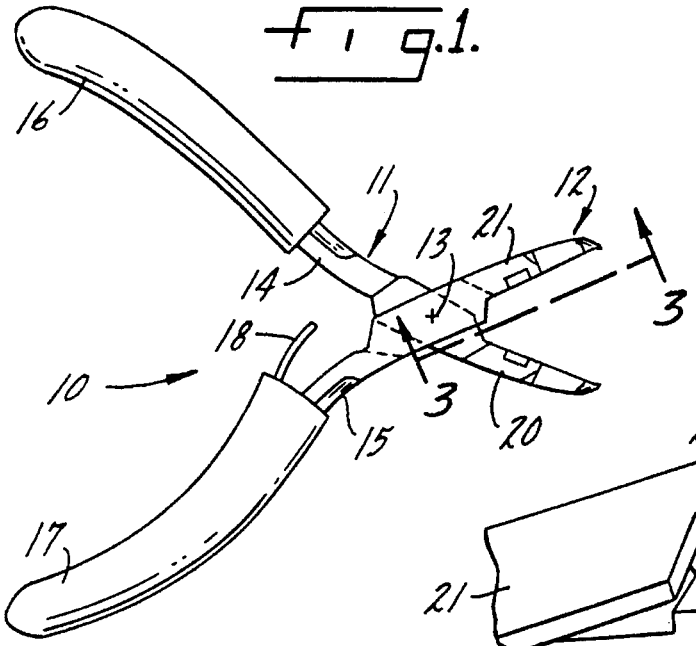
Fig.2.
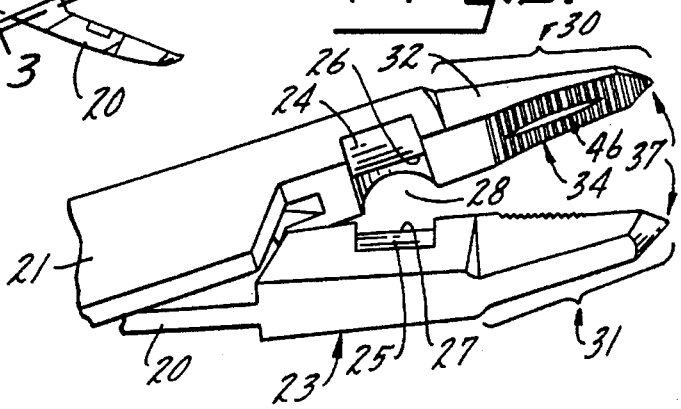
Fig.3.
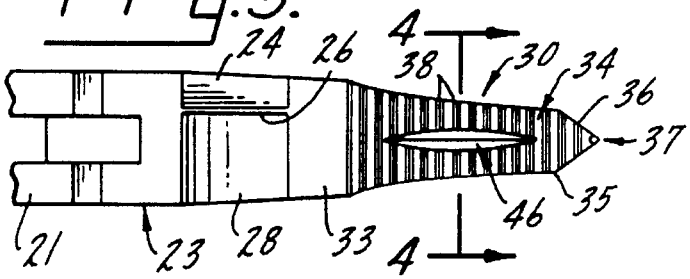
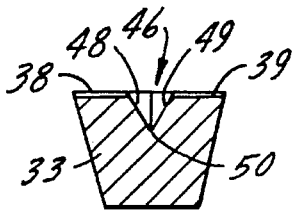
Fig.4.
Fig.5.
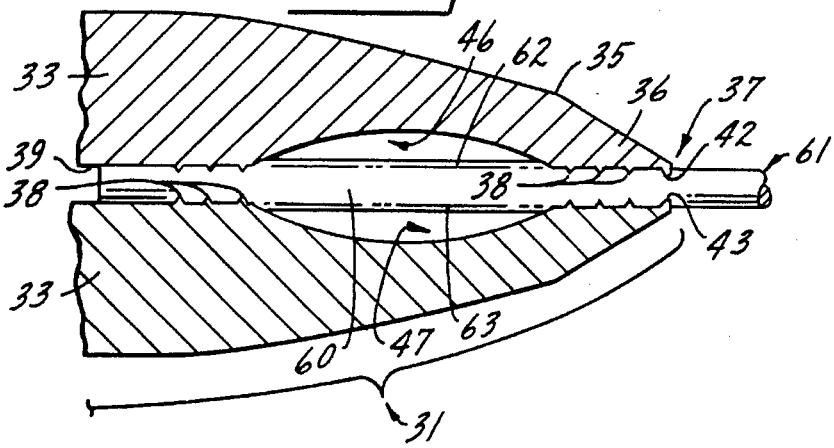

TWEEZER-PLIERS HAVING MULTIPLE GRIPPING MEANS

This invention relates generally to pliers and specifically to a pliers which has greater non-slip gripping power than conventional pliers together with the same degree of touch sensitivity possessed by the highest quality tweezers currently available. Thus the tool of the invention has the power and strength of a pliers, or even more, and the sensitivity of touch and function of the highest quality tweezers.

BACKGROUND OF THE INVENTION

Conventional pliers consist of two elongated pincer members which are pivotally connected, one to the other, with those portions of the elongated members rearwardly of the pivot forming handles suitable for gripping by a user's hands, and those portions of the elongated members forwardly of the pivot forming a gripping device consisting of two geometrically similar gripping arms or members, which gripping arms or members terminate in a common narrow end. The abutting surfaces of the end portions of the gripper members are almost invariably serrated to assist in obtaining a purchase on an article or work piece to be gripped.

In operation the pliers may be used merely to grip an object and pull it with respect to a resisting force, or hold an object stationary while another component of the object is displaced, as by pulling or pushing with respect to it. Another very common use of pliers is to grip an elongated object, such as a wire or rod-like element, and break the gripped elongated object next to the gripped location by flexing the pliers with respect to the axis of the gripped object. If the gripped object is brittle, such as a thin glass rod, the separation will occur instantly upon the first flex of the pliers with respect to the object and, almost without exception, right at the location where the edge of the pliers contacts the elongated object.

In the more usual situation of separating a more flexible object, such as a steel or copper wire, the pliers may have to be flexed a number of times until stress fracture of the flexible work piece occurs. Generally speaking the larger the object to be separated and the greater flexibility it has, the larger will be the number of flexing movements which must occur before separation takes place.

One difficulty with present pliers when used in connection with flexible objects such as copper wire is that slippage of the serrated surfaces of the gripping arms of the pliers which are in contact with the object to be separated frequently occurs. As a result the final break point of the wire or other object occurs at a location on the wire which is remote from the location next to which the gripper arms of the pliers initially contacted the wire. Hence, the objective of separating a wire at location X may not be achieved because a separation eventually takes place at a location Y which is spaced a distance Z from the initially desired location X.

Conventional pliers are usually quite capable of picking up objects of substantial size, such as approximately 1/16" square or even somewhat smaller objects. However the conventional pliers almost invariably have a blunt or rounded nose, often of about 1/16" thick in width or diameter, depending on the geometrical shape of the working ends of the gripper arms, and hence picking up very small objects, say on the order of about 1/64" or less, can be very difficult if not impossible. As is well known there are numerous industries in which a general purpose pliers is needed; that is, a pliers which can quickly and efficiently do heavy tasks such as bend wire or pull a workpiece with as much force as an individual can supply and, in the next moment, performing a very delicate pickup of a very small workpiece. No pliers are known which can perform all of the above described tasks by a single tool and hence a need exists for pliers which are very rugged and, at the same time, very sensitive and delicate so as to be able to perform the complete spectrum of tasks ranging from heavy pulling and thick wire flex-separation to pickup of the most delicate and smallest components, such as watch components, thread-like elements or even flat sheets.

It will also be appreciate that conventional pliers have only one gripping means, namely, a plurality of serrations on the inside, facing surfaces of the end portions of the gripping arms. Although this single gripping means is sufficient for a large number of common tasks, the more demanding and or unusual tasks can often not be accomplished with conventional pliers, no matter how fine the quality thereof.

SUMMARY OF THE INVENTION

The invention consists of a pliers which has the ability to perform the most rugged of tasks which small nose pliers are called on to do, such as grip firmly enough to enable the highest possible user force to be applied to a workpiece, or separate elongated objects by flexing without slippage from an initial gripping location, to picking up and subsequently handling very small objects, including objects down to 1/64" in width or diameter, or even less, including pickup of smooth flexible sheets, such as paper, at an angle perpendicular to the plane of the sheet.

BRIEF DESCRIPTION OF THE DRAWING

The invention is illustrated more or less diagrammatically in the accompanying drawing in which:

FIG. 1 is a top plan view of a first embodiment of the tweezer-pliers of this invention;

FIG. 2 is a perspective view of the operative ends of the gripper arms of the tweezer-pliers of FIG. 1 to an enlarged scale as shown in FIG. 1;

FIG. 3 is a side view taken substantially along the line 3—3 of FIG. 1 to an enlarged scale;

FIG. 4 is a view taken substantially along the line 4—4 of FIG. 3 to an enlarged scale as shown in FIG. 3;

FIG. 5 is a section through the jaw portions of the gripper arms in contact with a work piece which is gripped for purposes of further manipulation;

DESCRIPTION OF THE INVENTION

Figure 6:
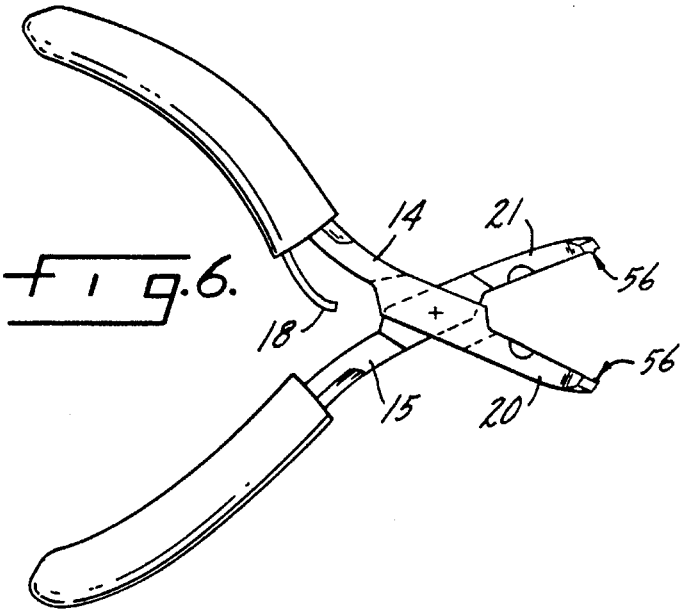
FIG. 6 is a top plan view of a second embodiment of the tweezer-pliers of this invention.

In the following description of the invention as illustrated in the Figures, like reference numerals will be used to refer to like or similar components from Figure to Figure.

The first embodiment of the tweezer-pliers of this invention is indicated generally at 10 in FIG. 1. The tweezer-pliers includes two elongated arms, indicated generally at 11, 12, which are pivotally connected by well known means at pivot 13. The rear end portions of the arms 11 and 12, that is, those portions lying to the left of pivot 13, are handle portions and are indicated at 14 and 15. The handle portions 14 and 15 are shown, in this instance, as covered with soft material such as a rubber-like or plastic sleeve 16, 17 respectively. A leaf spring is shown at 18 for applying a modest force acting in a direction to separate arms 11 and 12 when the spring engages arm 11 upon movement of the arms 11 and 12 toward one another in a closing direction. By generation of such a separating force the control of the closing and gripping action of the gripper arms by the user is enhanced.

The front end portions of the arms 11, 12, that is, those portions lying to the right of pivot 13, are gripper portions and are indicated at 20, 21. The gripper portions 20, 21 include, in this instance, a cutter section 23 which includes a pair of inclined cutter blades 24, 25 which terminate in cutting edges 26, 27. A clearance area, indicated at 28, lies on the opposite side of each cutting edge from the side which includes the inclined surface 24, 25, which terminates at the cutting edge.

The jaw section of each gripper portion is indicated generally at 30 and 31. Since the jaw sections are mirror images of one another, only one will be described.

Jaw section 30 includes a body portion 32 having a heel 33, see FIG. 3, and a jaw member indicated generally at 34. Jaw member 34 has a gradual taper, see FIG. 3, to a point 35 which forms a junction with the nose 36 which terminates in the tip indicated generally at 37. As can be seen best in FIGS. 3, 4 and 5 jaw member 34 includes a plurality of serrations formed by cross ridges 38 which extend upwardly from a base or reference surface 39, see FIGS. 4 and 5.

The tip 37 is shown in greatly exaggerated form in FIG. 5. It will be noted from that Figure that the tip 37 terminates in a pincer point consisting of a first component 42, formed on jaw section 30, and a second component 43 formed on jaw section 31. These two components 42, 43 are preferably formed by the process illustrated in U.S. Pat. No. 5,307,595, the disclosure of which is incorporated herein by reference, with particular reference to FIG. 4 of said patent. As there illustrated and described, the pincer point at tip 37 is so fine in contour and the two components 42, 43 meet so closely with one another, that objects of exceedingly small size, for example on the order of about 1/64" or less, can be easily grasped; indeed, objects can be grasped of a size which requires a magnifying glass for the human eye to detect with assurance. It will also be noted that the first and second components 42, 43 of the pincer point are somewhat longer in depth than the serrations 38 using base 39 as a reference point.

A particularly unique feature in the combination of features above described is a center groove formed in each of the jaw sections 30, 31, and indicated generally at 46, 47. Center groove 46 consists essentially of a groove formed by sides 48, 49 which meet at junction 50. As best seen in FIGS. 3, 4 and 5, the groove 46 has a maximum depth at approximately the midpoint of its length, and tapers toward reference surface 39. As will be seen from FIGS. 2, 3 and 5 the grooves preferably terminate a short distance behind tip 37. In this instance the center grooves terminate approximately three serrations short of the tip 37.

Figure 7:
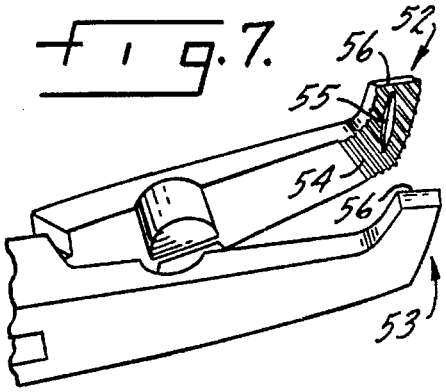
FIG. 7 is a perspective view of the operative ends of the gripper arms of the tweezer-pliers of FIG. 6 to an enlarged scale as shown in FIG. 6.

In the bent nose embodiment of FIGS. 6 and 7 the jaw sections 52, 53 are generally L-shaped as viewed when grasped in the right hand of a user. The serrations 54 are inclined from a medial line extending the main length of the jaw section and, also, from a medial line extending the length of the foot portion of the L-shaped configuration. One of the two mating center grooves in the stem portion of the L-shaped configuration is indicated at 55, the construction of said center groove and serrations being in all respects similar to that shown in the embodiment of FIGS. 1–5. The tip 56 of the nose is formed in all respects similar to the tip 37 of the embodiment of FIGS. 1–5.

The use and operation of the tweezer-pliers can be best appreciated from FIGS. 5, 8 and 9.

Referring first to FIG. 5 it will be seen that when the end portion 60 of workpiece 61 is grasped by the tweezer-plier, three gripping actions occur. Firstly, the individual serrations 38 bite into the workpiece 61 as best seen in FIG. 5. Secondly, the pincer points 42, 43 of tip 37, due to their pointed configurations (as compared to the lineal configurations of serrations 38) dig into, indeed gouge, the workpiece 61 to a greater depth than the serrations 38. Thirdly, the very strong gripping forces exerted from opposite directions onto the workpiece 61 from firstly, the two halves of nose 36 and, secondly, from the rear serrations 38 and heel 33, cause the contour of the workpiece to be flattened slightly at said two locations. Hence, that portion of the workpiece whose exterior surface is aligned with the center grooves 46, 47 do not have such distorting pressures exerted thereon and, as a consequence, remain substantially undistorted as seen in FIG. 5. As a result a shear resistance is exerted by the workpiece against slippage of the tweezer-pliers along the workpiece, the plane of shear resistance being represented by shear lines (or planes) 62, 63 in FIG. 5.

The practical effect of the increased gripping power of the tweezer-pliers of this invention is further illustrated in FIGS. 8*a*, 8*b*, 9*a* and 9*b*.

Figure 8A:
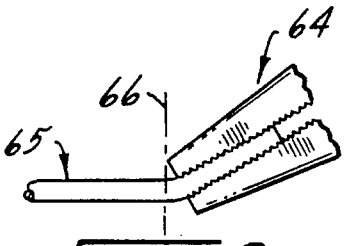
Fig. 8a. (PRIOR ART)
FIGS. 8*a* and 8*b* are illustrative of conventional prior art needle nosed pliers illustrating particularly the slippage which frequently occurs when said conventional prior art pliers are used to separate an elongated flexible workpiece such as a wire.
Figure 8B:
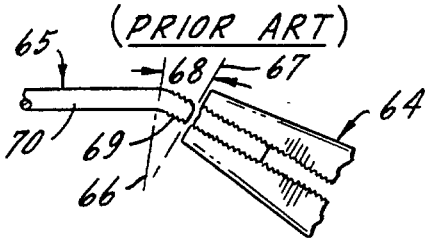
Fig. 8b. (PRIOR ART)

In FIG. 8*a* a conventional needle nose pliers 64 having serrated surfaces has grasped a workpiece indicated generally at 65 which may, for example, be a steel or copper wire of substantial thickness, and bent the wire upwardly in an attempt to sever the wire along desired severance plane 66. After repeated up and down flexings, represented by the different position of tweezer-pliers 64 in FIG. 8*b*, the workpiece 65 has been severed at severance plane 67. It will be noted however that severance plane 67 is located a substantial distance away from the desired severance plane 66. This is because the gripping power of a conventional pliers is insufficient to maintain the exact, initial gripping position of the workpiece and pliers during repeated flexings. In effect, the pliers 64 has slipped approximately the distance 68 from its starting position in which the nose of the pliers was co-extensive with a desired severance plane 66. The slippage is represented by the exposed serrations 69 which appear on the end of the main body 70 of the workpiece.

Figure 9A:
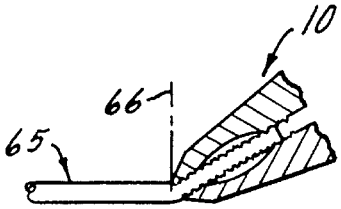
FIGS. 9*a* and 9*b* illustrate the tweezer-pliers of this invention used to separate an elongated flexible workpiece such as a wire.

Use of the tweezer-pliers of this invention however completely eliminates the possibility of slippage. The gripping power of the invention tool is so powerful by reason of the arrangement of parts as above described that the tool 10 does not slip from the intended severance plane 66, which is defined when the workpiece 65 is initially grasped as shown in FIG. 9*a*, to the final severance plane, also plane 66, after repeated flexings as shown in FIG. 9*b*.

Figure 9B:
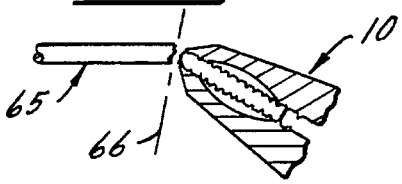

The versatility of the tweezer-pliers of this invention is demonstrated by the fact that immediately after a rugged workpiece 65 has been severed as in FIG. 9*b*, a fine piece of thread, or an object so small that magnification is desirable to clearly insure contact between the tool and workpiece preparatory to gripping, can be picked up and processed.

Although the invention has been described in considerable detail, it will be apparent to those skilled in the art that modifications may be made in the invention without departing from the spirit and scope of the invention. Accordingly it is intended that the scope of the invention be limited solely by the scope of the hereafter appended claims when interpreted in light of the relevant prior art, and not by the foregoing exemplary description.

I claim:

1. A pressure type gripping tool for gripping and maintaining non-slipping gripping engagement between said tool and a workpiece during hand applied gripping pressure, said tool being capable of gripping smooth fibrous surfaces, said tool including, in combination, two gripping members which are movable toward and away from one another from an open, pressure released position to a closed, gripping pressure applied position, each of said gripping members having a longitudinal axis and an inside base reference surface, the inside base reference surfaces of each of said gripping members being in abutting engagement with each other when the gripping members are in the closed, gripping pressure applied position, each of said gripping members also having firstly a plurality of high points and low points which extend along a portion of each of said gripping members, said high points extending outwardly from a reference base line defined by the inside base reference surface of each of said gripping members and being arranged to provide gripping contact with a workpiece when the gripping members are moved toward one another into the closed, gripping pressure applied position and secondly, pincer point means at the farthest point on the gripping member, said pincer point means being formed and contoured to form a pincer point when the gripping members are in abutting engagement with one another, said pincer point means having a member formed on each gripping member and extending outwardly from said gripping member's reference base a distance greater than the adjacent high points extend outwardly from said reference base, whereby said pincer point means penetrates a workpiece to be gripped to a greater depth than the said high points on the gripper members adjacent thereto.

2. The pressure type gripping tool of claim 1 further including groove means formed in the inside base reference surface of each gripping member, said groove means commencing inwardly from the farthest point on the gripping members and being aligned with the pincer point member on each gripping member, the groove means in each gripping member terminates short of the pincer point member on said gripping member, at least one high point is located between the end of the groove means closest to the pincer point member, and the pincer point member.

3. The pressure type gripping tool of claim 2 further characterized in that each of said groove means including a longitudinal axis, the longitudinal axis of each groove means is aligned with the longitudinal axis of its respective gripping member and the pincer point on said gripping member.

4. The pressure type gripping tool of claim 2 further characterized in that each of said groove means including a longitudinal axis, the longitudinal axis of each groove means is aligned with the pincer point on its associated gripper member but disposed transversely to the longitudinal axis of the gripping member.

5. The pressure type gripping tool of claim 2 further characterized in that the groove means are sufficiently deep at at least their mid-points so that no contact is made with a gripped object received therein.

6. The pressure type gripping tool of claim 5 further including biasing means which act in a direction to move the gripping members away from one another as said gripping members approach one another under a hand applied closing force.

7. A pressure type gripping tool for gripping and maintaining non-slipping gripping engagement between said tool and a workpiece during hand applied gripping pressure, said tool being capable of gripping smooth fibrous surfaces, said tool comprising:

two gripping members which are movable toward and away from one another from an open, pressure released position to a closed, gripping pressure applied position, each of said gripping members having a longitudinal axis and an inside base reference surface, the inside base reference surfaces of each of said gripping members being in abutting engagement with each other when the gripping members are in the closed, gripping pressure applied position, each of said gripping members also having firstly, a plurality of high points and low points which extend along a portion of the inside base reference surface of each of said gripping members, said high points extending outwardly from a reference base line defined by the base reference surface of each of said gripping members and being arranged to provide gripping contact with a workpiece when the gripping members are moved toward one another into the closed, gripping pressure applied position, secondly, pincer point means at the farthest point on the gripping member, said pincer point means being formed and contoured to form a pincer point when the gripping members are in abutting engagement with one another, said pincer point means having a member formed on each gripping member and extending outwardly from said gripping member's reference base a distance greater than the adjacent high points extend outwardly from said reference base, whereby said pincer point means penetrates a workpiece to be gripped to a greater depth than the said high points on the gripper members adjacent thereto, and thirdly, groove means formed in the inside base reference surface of each gripping member, said groove means commencing inwardly from the farthest point on the gripping members and being aligned with the pincer point member on each gripping member, the groove means in each gripping member terminates short of the pincer point member on said gripping member, at least one high point is located between the end of the groove means closest to the pincer point member and the pincer point member.

8. The pressure type gripping tool of claim 7 further characterized in that each of said groove means including a longitudinal axis, the longitudinal axis of each groove means is aligned with the longitudinal axis of the gripping member and the pincer point on said gripping member.

9. The pressure type gripping tool of claim 7 further characterized in that each of said groove means including a longitudinal axis, the longitudinal axis of each groove means is aligned with the pincer point on its associated gripper member but disposed transversely to the longitudinal axis of the gripping member.

* * * * *